US008616173B2

(12) United States Patent
Hayman

(10) Patent No.: US 8,616,173 B2
(45) Date of Patent: Dec. 31, 2013

(54) ENGINE ASSEMBLY INCLUDING MODIFIED INTAKE PORT ARRANGEMENT

(75) Inventor: Alan W. Hayman, Romeo, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 369 days.

(21) Appl. No.: 12/962,983

(22) Filed: Dec. 8, 2010

(65) Prior Publication Data

US 2012/0145111 A1 Jun. 14, 2012

(51) Int. Cl.
*F02F 1/42* (2006.01)

(52) U.S. Cl.
USPC ..... 123/193.5; 123/302; 123/432; 123/71 R; 123/71 B; 123/70 R; 123/568.11; 123/568.13; 123/65 A; 123/65 WA

(58) Field of Classification Search
USPC ..... 123/193.5, 71 R, 71 B, 70 R, 568.11, 123/568.13, 65 A, 65 WA
See application file for complete search history.

(56) References Cited

U.S. PATENT DOCUMENTS

| | | | | |
|---|---|---|---|---|
| 2,804,862 | A * | 9/1957 | Nedwidek | 123/432 |
| 3,924,576 | A | 12/1975 | Siewert | |
| 4,036,184 | A * | 7/1977 | Guenther | 123/286 |
| 4,498,429 | A * | 2/1985 | Satow et al. | 123/26 |
| 4,506,633 | A | 3/1985 | Britsch | |
| 4,565,167 | A * | 1/1986 | Bryant | 123/70 R |
| 5,056,486 | A * | 10/1991 | Johannes | 123/432 |
| 5,217,229 | A | 6/1993 | Jaime | |
| 6,286,467 | B1 | 9/2001 | Ancheta | |
| 6,505,592 | B1 | 1/2003 | Hayman et al. | |
| 6,886,516 | B2 * | 5/2005 | Harui | 123/184.52 |
| 7,028,648 | B2 | 4/2006 | Hasegawa et al. | |
| 7,036,465 | B2 | 5/2006 | Burk et al. | |
| 7,281,527 | B1 * | 10/2007 | Bryant | 123/564 |
| 8,132,546 | B2 | 3/2012 | Surnilla | |
| 2006/0112940 | A1 | 6/2006 | Roberts et al. | |
| 2008/0201059 | A1 * | 8/2008 | Bryant | 701/103 |
| 2009/0308070 | A1 | 12/2009 | Alger, II et al. | |
| 2012/0042649 | A1 | 2/2012 | Kaneko et al. | |
| 2012/0048244 | A1 | 3/2012 | Hayman et al. | |

FOREIGN PATENT DOCUMENTS

| | | | |
|---|---|---|---|
| DE | 3007746 | A1 | 9/1981 |
| DE | 69301470 | T2 | 10/1996 |
| EP | 1167715 | A2 | 1/2002 |
| WO | 2008031939 | A2 | 3/2008 |

OTHER PUBLICATIONS

Hundleby, G.E., "Development of a Poppet-Valved Two-Stroke Engine—The Flagship Concept", Ricardo Consulting Engineers Ltd., SAE International Paper No. 900802, Feb. 1, 1990, 6 pgs.

* cited by examiner

*Primary Examiner* — Marguerite McMahon
*Assistant Examiner* — James Kim
(74) *Attorney, Agent, or Firm* — Harness, Dickey & Pierce, P.L.C.

(57) ABSTRACT

An engine assembly may include an engine block, a first piston, a second piston, and a cylinder head. The cylinder head and the engine block may define a first combustion chamber and a second combustion chamber. The cylinder head may define a first intake port and a second intake port. The first intake port may be in communication with the first combustion chamber and may include a first inlet extending through an upper surface of the cylinder head. The second intake port may be in communication with the second combustion chamber and may include a second inlet extending through a side of the cylinder head.

11 Claims, 4 Drawing Sheets

ENGINE ASSEMBLY INCLUDING MODIFIED INTAKE PORT ARRANGEMENT

FIELD

The present disclosure relates to engine intake port arrangements.

BACKGROUND

This section provides background information related to the present disclosure which is not necessarily prior art.

Internal combustion engines may combust a mixture of air and fuel in cylinders and thereby produce drive torque. Combustion of the air-fuel mixture produces exhaust gases. Engines may include intake ports to direct and air flow to the combustion chambers.

SUMMARY

An engine assembly may include an engine block, a first piston, a second piston, and a cylinder head. The engine block may define first and second cylinder bores with the first piston located in the first cylinder bore and the second piston located in the second cylinder bore. The cylinder head may be coupled to the engine block and may cooperate with the first cylinder bore and the first piston to define a first combustion chamber and with the second cylinder bore and the second piston to define a second combustion chamber. The cylinder head may define a first intake port and a second intake port. The first intake port may be in communication with the first combustion chamber and may include a first inlet extending through an upper surface of the cylinder head. The second intake port may be in communication with the second combustion chamber and may include a second inlet extending through a side of the cylinder head.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
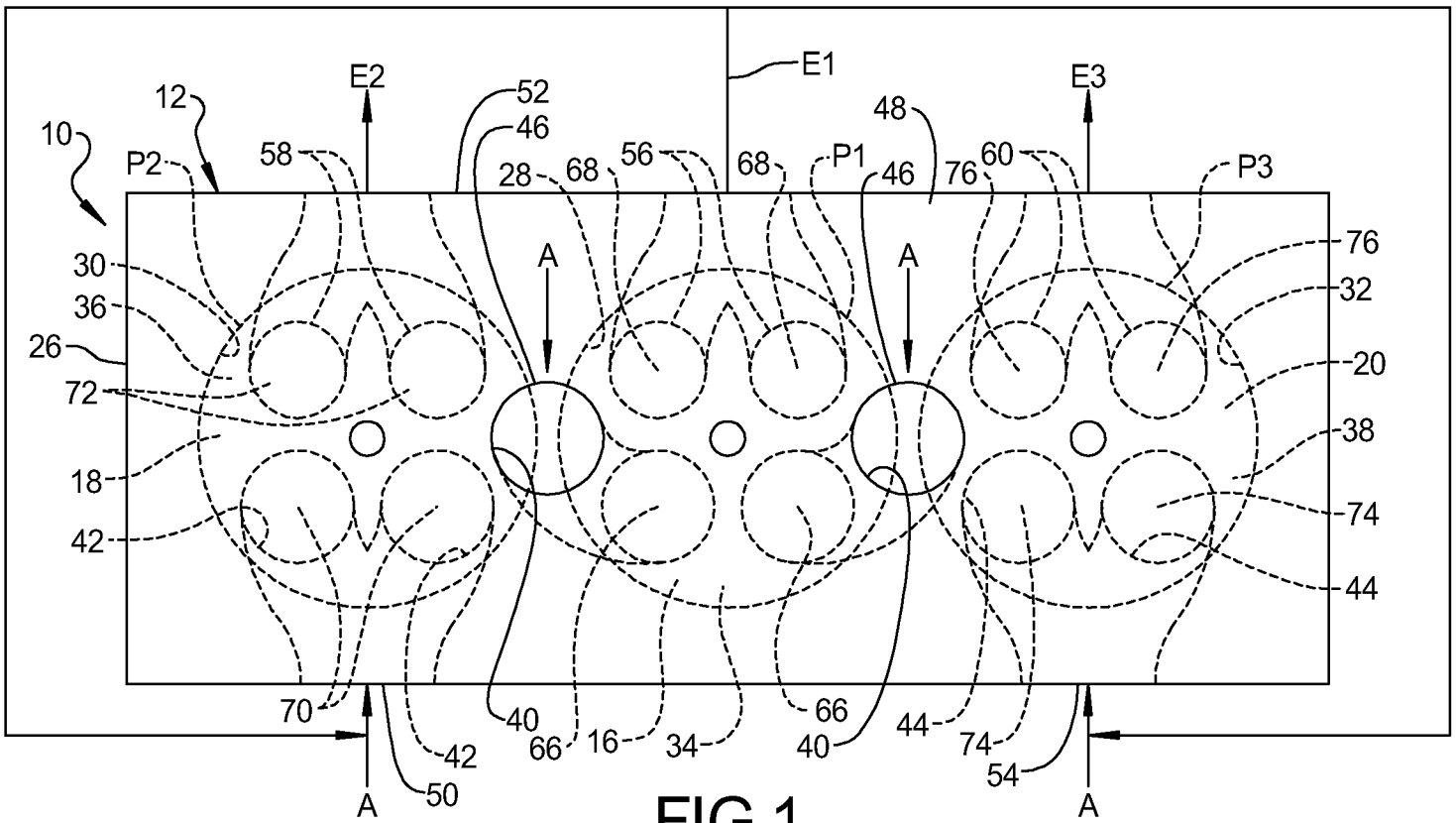
FIG. 1 is a schematic illustration of an engine assembly according to the present disclosure.
Figure 2:
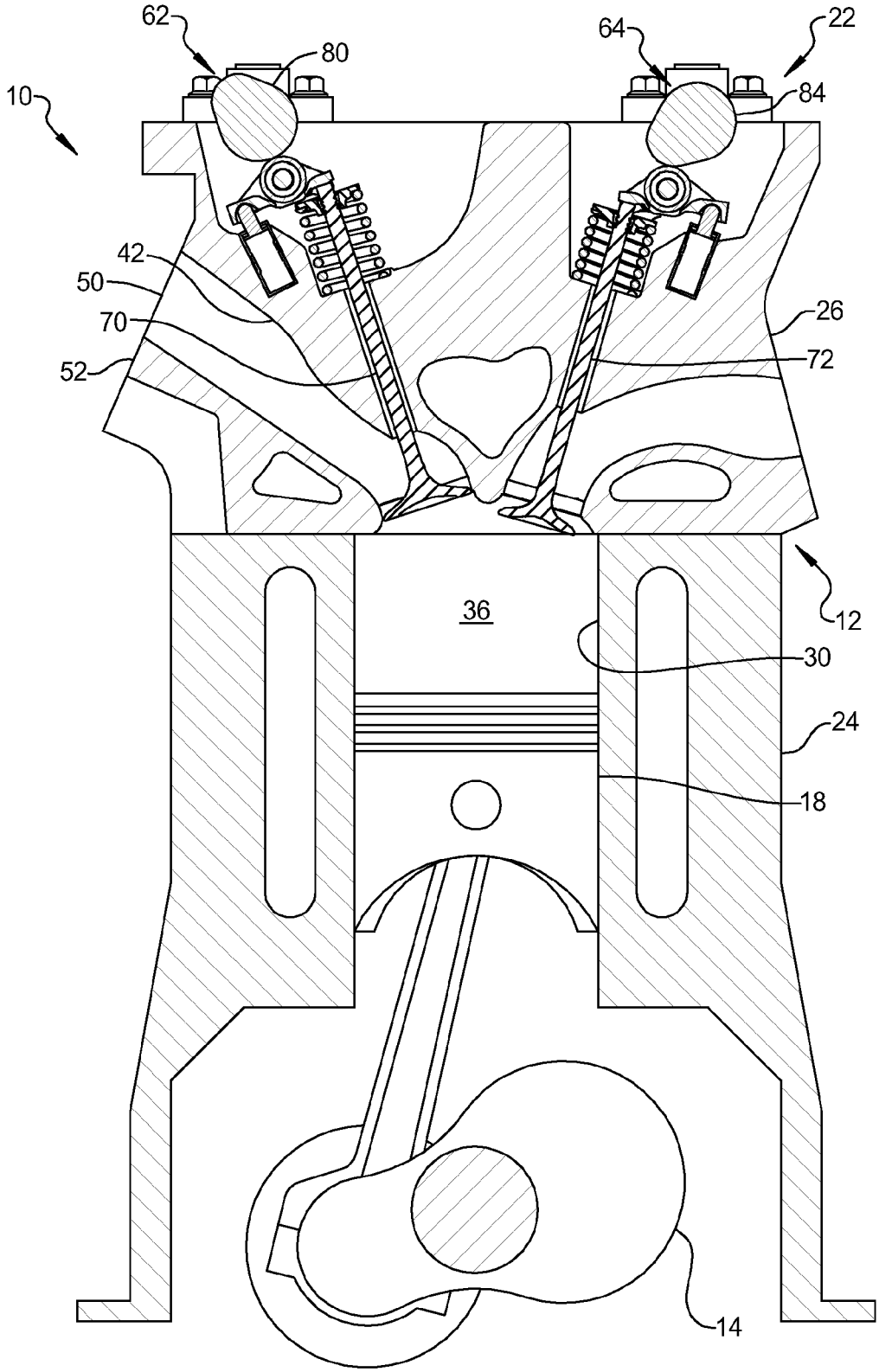
FIG. 2 is a schematic section view of the engine assembly of FIG. 1.
Figure 3:
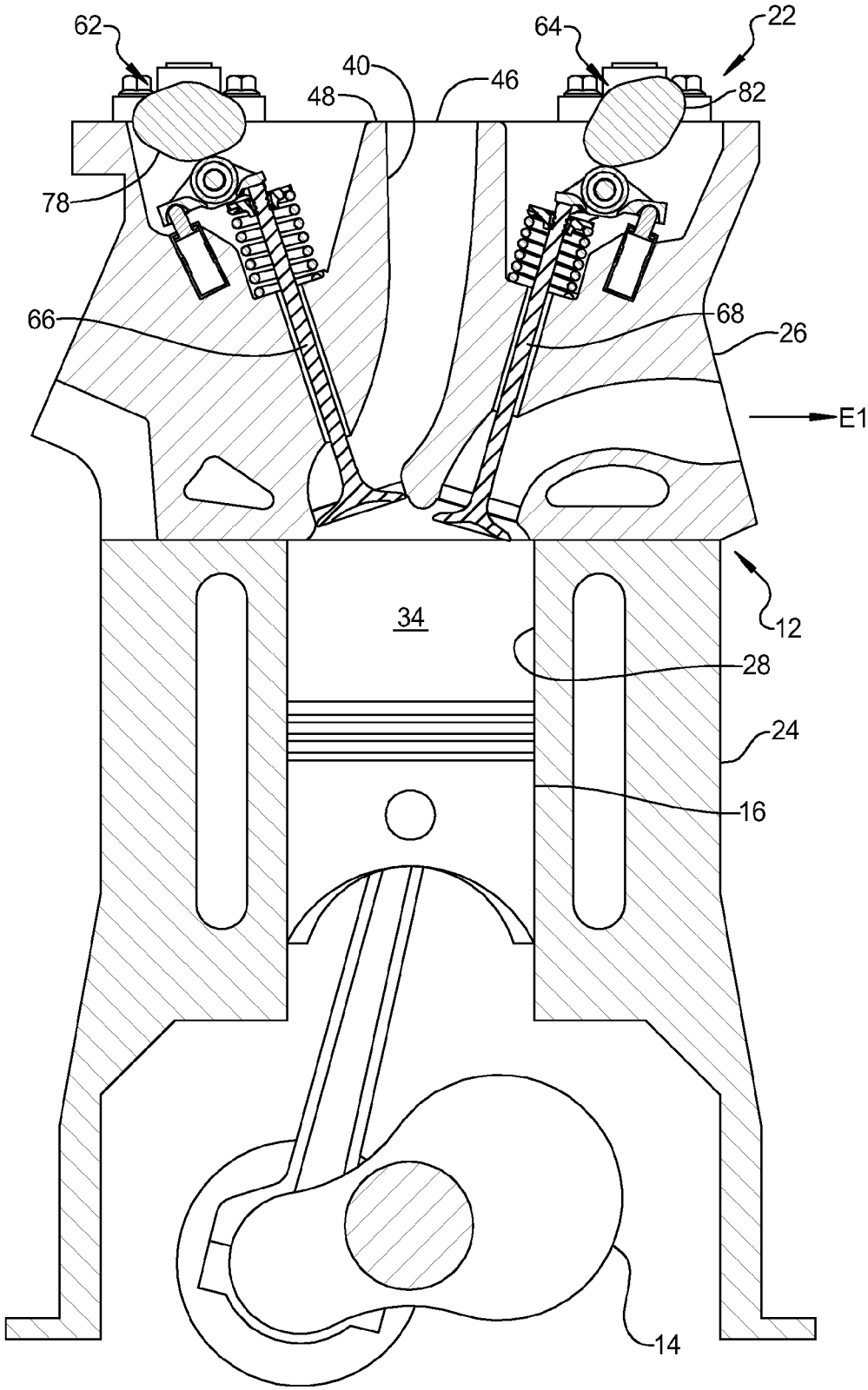
FIG. 3 is an additional schematic section view of the engine assembly of FIG. 1.

An engine assembly 10 is illustrated in FIGS. 1-3 and may include an engine structure 12, a crankshaft 14, first, second and third pistons 16, 18, 20, and a valvetrain assembly 22. The engine structure 12 may include an engine block 24 and a cylinder head 26. The engine structure 12 may define first, second and third cylinder bores 28, 30, 32. The first cylinder bore 28 may be located between the second and third cylinder bores 30, 32 along a longitudinal extent of the engine block 24.

The first piston 16 may be located in the first cylinder bore 28, the second piston 18 may be located in the second cylinder bore 30, and the third piston 20 may be located in the third cylinder bore 32. The cylinder head 26 cooperates with the first cylinder bore 28 and the first piston 16 to define a first combustion chamber 34, cooperates with the second cylinder bore 30 and the second piston 18 to define a second combustion chamber 36, and cooperates with the third cylinder bore 32 and the third piston 20 to define a third combustion chamber 38.

While described in combination with a three cylinder inline engine configuration, it is understood that the present teachings apply to any number of piston-cylinder arrangements and a variety of reciprocating engine configurations including, but not limited to, V-engines, inline engines, and horizontally opposed engines, as well as both overhead cam and cam-in-block configurations.

The cylinder head 26 may define first intake ports 40 in communication with the first combustion chamber 34 that provide air flow (A) to the first combustion chamber 34, second intake ports 42 in communication with the second combustion chamber 36 that provide air flow (A) to the second combustion chamber 36, and third intake ports 44 in communication with the third combustion chamber 38 that provide air flow (A) to the third combustion chamber 38. The first intake port 40 may include a first inlet 46 extending through an upper surface 48 of the cylinder head 26. The second intake port 42 may include a second inlet 50 extending through a side 52 of the cylinder head 26. The third intake port 44 may include a third inlet 54 extending through the side 52 of the cylinder head 26.

The first intake port 40 may be spaced from the second intake port 42 along a longitudinal extent of the cylinder head 26. In the present non-limiting example, the first intake port 40 may be located between the second intake port 42 and the third intake port 44 along the longitudinal extent of the cylinder head 26. The first inlet 46 may be located laterally within an outer periphery (P1) defined by the first combustion chamber 34. The second inlet 50 may be located laterally outward from an outer periphery (P2) defined by the second combustion chamber 36 and the third inlet 54 may be located laterally outward from an outer periphery (P3) defined by the third combustion chamber 38.

The cylinder head 26 may additionally define first exhaust ports 56 in communication with the first combustion chamber 34 that direct exhaust gas flow (E1) from the first combustion chamber 34, second exhaust ports 58 in communication with the second combustion chamber 36 that direct exhaust gas flow (E2) from the second combustion chamber 36, and third exhaust ports 60 in communication with the third combustion chamber 38 that direct exhaust gas flow (E3) from the third combustion chamber 38.

The second intake port 42 and the third intake port 44 may each extend at an angle relative to the first intake port 40. The first intake port 40 may define a downward flow path into the first combustion chamber 34. In the non-limiting example shown in FIG. 3, the downward flow path is defined by a curved flow path.

Figure 4:
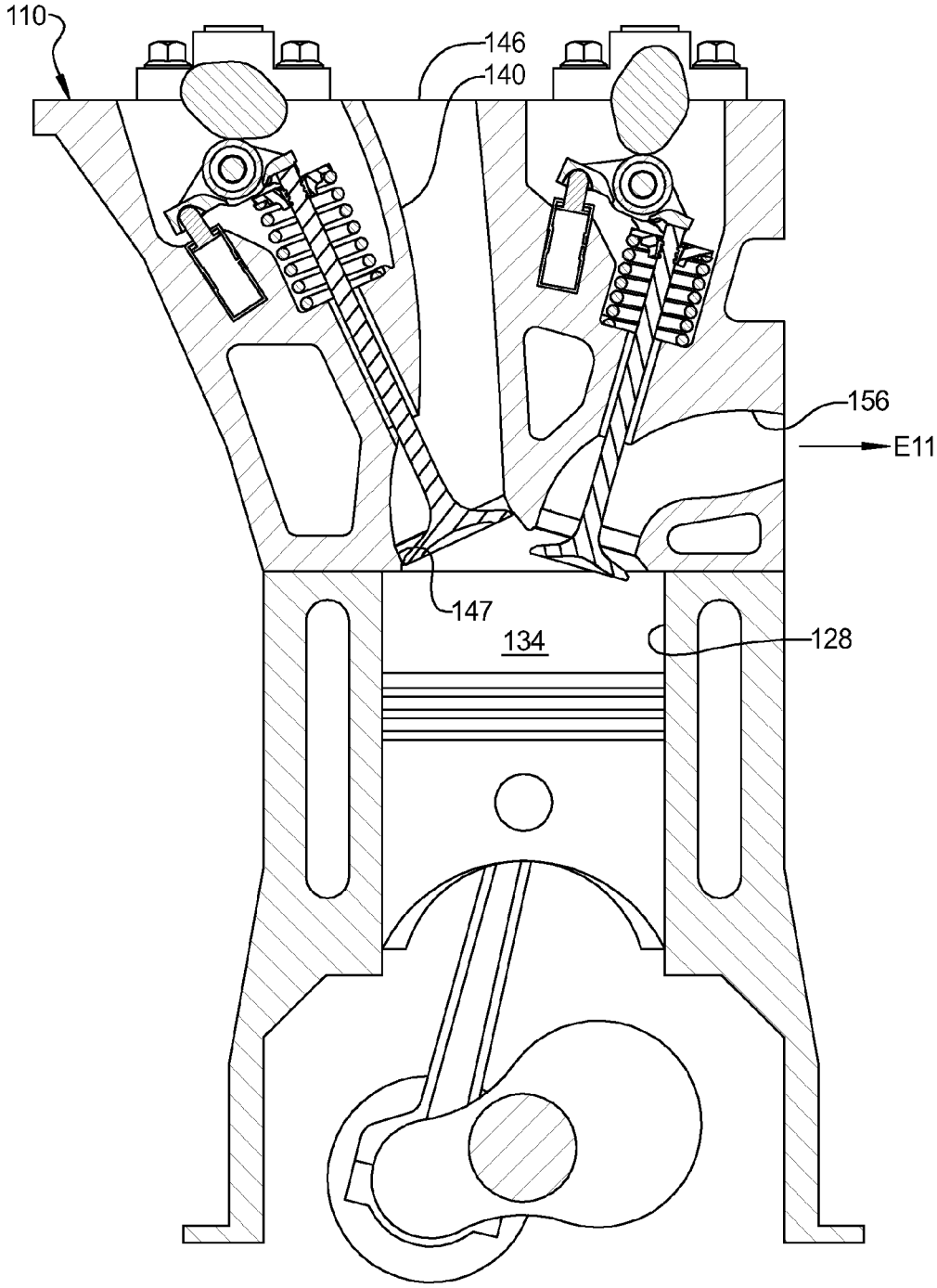
FIG. 4 is a schematic section view of engine assembly illustrating an alternate port arrangement according to the present disclosure.

In an alternate arrangement, seen in FIG. 4, the downward flow path defined by the first intake port 140 of the engine assembly 110 may have a generally continuous vertical extent (parallel to a reciprocating axis defined by the first cylinder bore 128). More specifically, the first intake port 140 may define a continuous downward vertical extent from the inlet 146 to an outlet 147 of the first intake port 140.

In the arrangement of FIG. 3 or FIG. 4, the downward flow path of the first intake port 40, 140 may direct an intake air flow toward a bottom of the first combustion chamber 34, 134 to force exhaust gas (E1, E11) from the bottom of the first combustion chamber 34, 134 upward toward the first exhaust port 56, 156. While the remaining description is directed to the engine assembly 10, it is understood that the engine assembly 10 may be modified to include the arrangement of the first intake port 140 shown in FIG. 4.

Referring back to FIGS. 1-3, the first exhaust port 56 may be in communication with the second combustion chamber 36 and the third combustion chamber 38 and may provide exhaust gas (E1) from the first combustion chamber 34 to the second combustion chamber 36 and the third combustion chamber 38 for a subsequent combustion event.

The first combustion chamber 34 may form a two-stroke operating cycle combustion chamber having one combustion event for each crankshaft revolution. The second combustion chamber 36 may form a four-stroke operating cycle combustion chamber having one combustion event per two crankshaft revolutions. The third combustion chamber 38 may also form a four-stroke operating cycle combustion chamber having one combustion event per two crankshaft revolutions.

The valvetrain assembly 22 may include a first camshaft 62, a second camshaft 64, first intake valves 66 located in the first intake ports 40, first exhaust valves 68 located in the first exhaust ports 56, second intake valves 70 located in the second intake ports 42, second exhaust valves 72 located in the second exhaust ports 58, third intake valves 74 located in the third intake ports 44, and third exhaust valves 76 located in the third exhaust ports 60. The first camshaft 62 may form an intake camshaft and may include a first set of intake lobes 78 and a second set of intake lobes 80. The second camshaft 64 may form an exhaust camshaft and may include a first set of exhaust lobes 82 and a second set of exhaust lobes 84.

The intake lobes from the first set of intake lobes 78 may have twice the number of peaks as the intake lobes from the second set of intake lobes 80 to accommodate the two-stroke operating cycle of the first combustion chamber 34. Similarly, the exhaust lobes from the first set of exhaust lobes 82 may have twice the number of peaks as the exhaust lobes from the second set of exhaust lobes 84 to accommodate the two-stroke operating cycle of the first combustion chamber 34. In the present non-limiting example, the first and second camshafts 62, 64 may rotate at one-half of the rotational speed of the crankshaft 14. Therefore, the first intake and exhaust valves 66, 68 may each be opened once per crankshaft revolution and the second intake and exhaust valves 70, 72 and the third intake and exhaust valves 74, 76 may each be opened once per two crankshaft revolutions to accommodate the multi-cycle arrangement (two-stroke and four-stroke operating cycles).

What is claimed is:

1. An engine assembly comprising:

an engine block defining a first cylinder bore and a second cylinder bore;

a first piston located in the first cylinder bore;

a second piston located in the second cylinder bore; and a cylinder head coupled to the engine block, cooperating with the first cylinder bore and the first piston to define a first combustion chamber and cooperating with the second cylinder bore and the second piston to define a second combustion chamber, the cylinder head defining:

a bottom surface connected to the engine block, an upper surface opposite the bottom surface and a side surface extending between the bottom surface and the upper surface;

a pair of first intake ports in communication with the first combustion chamber and including a pair of first inlets extending through the upper surface of the cylinder head that provide an entire air flow to the first combustion chamber; and a pair of second intake ports in communication with the second combustion chamber and including a pair of second inlets extending through the side surface of the cylinder head that provide an entire air flow to the second combustion chamber.

2. The engine assembly of claim 1, wherein the first intake port defines a downward flow path into the first combustion chamber.

3. The engine assembly of claim 1, wherein the cylinder head defines a first exhaust port defined in the cylinder head, the downward flow path of the first intake port directing an intake air flow toward a bottom of the first combustion chamber to force exhaust gas from the bottom of the first combustion chamber upward toward the first exhaust port.

4. The engine assembly of claim 2, wherein the second intake port extends at an angle relative to the first intake port.

5. The engine assembly of claim 1, wherein the first intake port is spaced from the second intake port along a longitudinal extent of the cylinder head and the first inlet is located laterally within an outer periphery of the first combustion chamber.

6. The engine assembly of claim 5, wherein the second inlet is located laterally outward from an outer periphery of the second combustion chamber.

7. The engine assembly of claim 2, further comprising a third piston located in a third cylinder bore defined by the engine block, the cylinder head cooperating with the third cylinder bore and the third piston to define a third combustion chamber and defining a third intake port in communication with the third combustion chamber with a third inlet extending through a side of the cylinder head.

8. The engine assembly of claim 7, wherein the first cylinder bore is located between the second cylinder bore and the third cylinder bore along a longitudinal extent of the engine block.

9. The engine assembly of claim 1, wherein the first combustion chamber defines a two-stroke operating cycle combustion chamber and the second combustion chamber defines a four-stroke operating cycle combustion chamber.

10. The engine assembly of claim 1, wherein the cylinder head defines a first exhaust port in communication with the first combustion chamber and the second combustion chamber and providing exhaust gas from the first combustion chamber to the second combustion chamber.

11. An engine assembly comprising:

an engine block defining a first cylinder bore and a second cylinder bore;

a first piston located in the first cylinder bore;

a second piston located in the second cylinder bore; and a cylinder head coupled to the engine block, cooperating with the first cylinder bore and the first piston to define a two-stroke operating cycle combustion chamber and cooperating with the second cylinder bore and the second piston to define a four-stroke operating cycle combustion chamber, the cylinder head defining:

a bottom surface connected to the engine block, an upper surface opposite the bottom surface and a side surface extending between the bottom surface and the upper surface;

a pair of first intake ports in communication with the two-stroke operating cycle combustion chamber and including a pair of first inlets extending through the upper surface of the cylinder head that provide an entire air flow to the two-stroke operating combustion chamber;

a pair of second intake ports in communication with the four-stroke operating cycle combustion chamber and including a pair of second inlets extending through the side surface of the cylinder head that provide an entire air flow to the four-stroke operating cycle combustion chamber; and a first exhaust port in communication with the two-stroke operating combustion chamber and the four-stroke operating combustion chamber and providing exhaust gas from the two-stroke operating combustion chamber to the four-stroke operating combustion chamber.

* * * * *